US009392819B2

(12) United States Patent
Giannini et al.

(10) Patent No.: US 9,392,819 B2
(45) Date of Patent: Jul. 19, 2016

(54) METHOD AND MACHINE FOR PRODUCING PAPERLESS FILTER RODS FOR SMOKING ARTICLES

(71) Applicant: MONTRADE S.r.l., Bologna (IT)

(72) Inventors: Antonella Giannini, Bologna (IT); Alberto Monzoni, Bologna (IT)

(73) Assignee: MONTRADE S.R.L. (IT)

( * ) Notice: Subject to any disclaimer, the term of this patent is extended or adjusted under 35 U.S.C. 154(b) by 582 days.

(21) Appl. No.: 13/784,603

(22) Filed: Mar. 4, 2013

(65) Prior Publication Data

US 2013/0231232 A1 Sep. 5, 2013

(30) Foreign Application Priority Data

Mar. 5, 2012 (IT) ..... BO2012A0106

(51) Int. Cl.
*A24D 3/02* (2006.01)

(52) U.S. Cl.
CPC ..... *A24D 3/0229* (2013.01); *A24D 3/0233* (2013.01)

(58) Field of Classification Search
CPC ..... A24D 3/0229; A24D 3/0233
USPC ..... 493/44, 39, 45, 46, 48, 49, 50
See application file for complete search history.

(56) References Cited

U.S. PATENT DOCUMENTS 1,092,354 A 4/1914 Hamilton
2,916,039 A * 12/1959 Muller ..... 131/341
3,081,951 A * 3/1963 Dyer ..... A24D 3/0233 239/413
3,095,343 A * 6/1963 Berger ..... A24D 3/0233 131/343
3,111,702 A * 11/1963 Berger ..... A24D 3/0233 131/207
3,297,512 A * 1/1967 Cobb, Jr. et al. ..... 156/433
3,313,665 A 4/1967 Berger
3,361,137 A * 1/1968 Watson ..... 131/332
3,371,000 A * 2/1968 Davenport et al. ..... 156/180

(Continued)

FOREIGN PATENT DOCUMENTS

CN 102166041 8/2011
CN 202941402 5/2013

(Continued)

OTHER PUBLICATIONS

Notice of Opposition & Accompanying Papers.

(Continued)

*Primary Examiner* — Hemant M Desai
*Assistant Examiner* — Lucas Palmer
(74) *Attorney, Agent, or Firm* — The Belles Group, P.C.

(57) ABSTRACT

A method and machine for producing paperless filter rods for smoking articles, according to which a tow band of hardening-material-impregnated filtering material is fed along a forming beam having a first portion along which the tow band is injected with steam to cause the hardening material to react, and a second portion along which the tow band is dried with air, coming out from the forming beam, a continuous paperless rigid rod filter, which is fed to a cutting device; the steam blowing being performed at a plurality of stations arranged in series along the first portion; and the steam being fed, at each station, into an accumulation chamber surrounding the forming channel and communicating with the forming channel through an annular nozzle arranged on a transverse plane to the forming channel and having a constant width, measured along an axis of the forming channel, of 0.3 to 0.9 mm.

19 Claims, 5 Drawing Sheets

(56) References Cited

U.S. PATENT DOCUMENTS

| | | | | | |
|---|---|---|---|---|---|
| 3,377,220 | A | * | 4/1968 | Berger | A24D 3/0233 156/62.2 |
| 3,455,766 | A | | 7/1969 | Berger et al. | |
| 3,466,358 | A | * | 9/1969 | Muller | 264/287 |
| 3,519,521 | A | * | 7/1970 | Muller | 425/343 |
| 3,560,298 | A | * | 2/1971 | Beard et al. | A24D 3/0233 131/343 |
| 3,646,855 | A | * | 3/1972 | Muller | 493/43 |
| 3,656,484 | A | * | 4/1972 | Roberts | A24D 3/0233 131/343 |
| 3,658,626 | A | * | 4/1972 | Berger | A24D 3/0208 156/441 |
| 3,774,508 | A | * | 11/1973 | Berger et al. | 493/47 |
| 3,819,435 | A | * | 6/1974 | Roberts | A24D 3/0233 156/296 |
| 3,826,177 | A | * | 7/1974 | Berger et al. | 493/43 |
| 3,847,064 | A | * | 11/1974 | Berger | 493/44 |
| 3,852,009 | A | * | 12/1974 | Roberts | A24D 3/0233 131/343 |
| 3,912,572 | A | * | 10/1975 | Lacon | 156/381 |
| 3,930,935 | A | * | 1/1976 | Muller et al. | 162/361 |
| 3,939,022 | A | * | 2/1976 | Lacon | 156/200 |
| 4,036,114 | A | * | 7/1977 | Luke | 493/39 |
| 4,046,063 | A | * | 9/1977 | Berger | 493/43 |
| 4,059,043 | A | * | 11/1977 | Berger | 493/43 |
| 4,076,479 | A | * | 2/1978 | Lacon | B29C 35/06 425/301 |
| 4,088,065 | A | * | 5/1978 | Hall | 493/48 |
| 4,166,090 | A | * | 8/1979 | Green | A24D 3/0233 264/113 |
| 4,291,711 | A | * | 9/1981 | Berger | A24D 3/043 131/336 |
| 4,357,188 | A | * | 11/1982 | Mochida et al. | 156/180 |
| 4,412,829 | A | * | 11/1983 | Lebet et al. | 493/48 |
| 4,436,517 | A | * | 3/1984 | Lebet | 493/45 |
| 4,507,107 | A | * | 3/1985 | Berger | A24D 3/0233 156/296 |
| 4,508,525 | A | * | 4/1985 | Berger | 493/43 |
| 4,549,875 | A | * | 10/1985 | Pryor | A24D 3/022 493/44 |
| 4,637,409 | A | * | 1/1987 | Berger | 131/336 |
| 4,642,262 | A | * | 2/1987 | Piotrowski | D01D 5/11 264/115 |
| 4,655,230 | A | | 4/1987 | Bryant et al. | |
| 4,747,814 | A | * | 5/1988 | Berger | 493/44 |
| 4,869,274 | A | * | 9/1989 | Berger | D02J 13/00 131/92 |
| 4,954,060 | A | * | 9/1990 | Hsu | A23P 1/02 264/118 |
| 5,072,744 | A | * | 12/1991 | Luke et al. | 131/375 |
| 5,234,397 | A | * | 8/1993 | Wahle et al. | 493/4 |
| 5,523,036 | A | * | 6/1996 | Luke et al. | 264/45.3 |
| 5,620,641 | A | * | 4/1997 | Berger | 264/103 |
| 5,911,224 | A | | 6/1999 | Berger | |
| 2003/0173418 | A1 | * | 9/2003 | Koborinai et al. | 239/292 |
| 2008/0102145 | A1 | * | 5/2008 | Kim | D01D 5/0069 425/72.2 |
| 2012/0231946 | A1 | * | 9/2012 | Goda | D04H 1/407 502/7 |

FOREIGN PATENT DOCUMENTS

| | | | |
|---|---|---|---|
| DE | 1296066 | | 5/1969 |
| DE | 1532046 | | 10/1971 |
| DE | 3785040 | | 7/1993 |
| GB | 970817 | | 9/1964 |
| JP | WO 2011/065262 | * | 6/2011 |
| WO | 2011148130 | | 12/2011 |

OTHER PUBLICATIONS

Filtrona NWZ Process Manual, pp. 1048-1123.

Intermach Limited Genuine Spare Parts, International Machinery Design, Manufacture and Refurbishment, Unit 5, Winchester Drive, South West Industrial Estate, Peterlee, SR8 2RJ, United Kingdom.

Calleson, Donald A., Tow-Guide Insert for NWA Steam Garniture, Notebook pp. 269801, 269802, Feb. 18, 1980, Search: Legacy Tobacco Documents Library, http://legacy.library.ucsf.edu/action/search/advances;isessionid=43394A3D1892C56 . . . found on Jun. 25, 2015.

Calleson, Donald A., NWA—Current Status, Feb. 19, 1980, Search: Legacy Tobacco Documents Library, http://legacy.library.ucsf.edu/action/search/advanced?p=1&sq%5B0%5D.q=khlb0087 . . . found on Jun. 25, 2015.

International Machinery Design, Manufacture and Refurbishment, 5 Winchester Drive, South West Industrial Estate, Peterlee, County Durham, SR8 2RJ, United Kingdom, http://home2.btconnect.com/WOLF--TECHNICAL-/index.htm, Jun. 14, 2015.

NWA Filters for Improved Ventilated Cigarettes, Filtrona International Ltd.,Friendly House, 21-24 Chiswell Street, London, EC1Y 4UD, England http://industrydocuments.librarydocuments.library.ucsf.edu/tobacco/docs/txxy0099.

Search results: Legacy Tobacco Documents Library, DILUTION, http://industrydocuments.library.ucsf.edu/tobacco/results/, Jun. 29, 2015.

Calleson, D.A., Search results: Legacy Tobacco Documents Library, Trip Report—Tennessee Eastman, dated Dec. 3, 1979, http://industrydocuments.library.ucsf.edu/tobacco/results/, found Jun. 29, 2015.

MONO NWA—Filter Rod Maker, Filter Rod Making Science, pp. 9-12, Via Torretta, 28, 40012 Calderana di Rano (Bologna)—Italy, www.montrade.it.

* cited by examiner

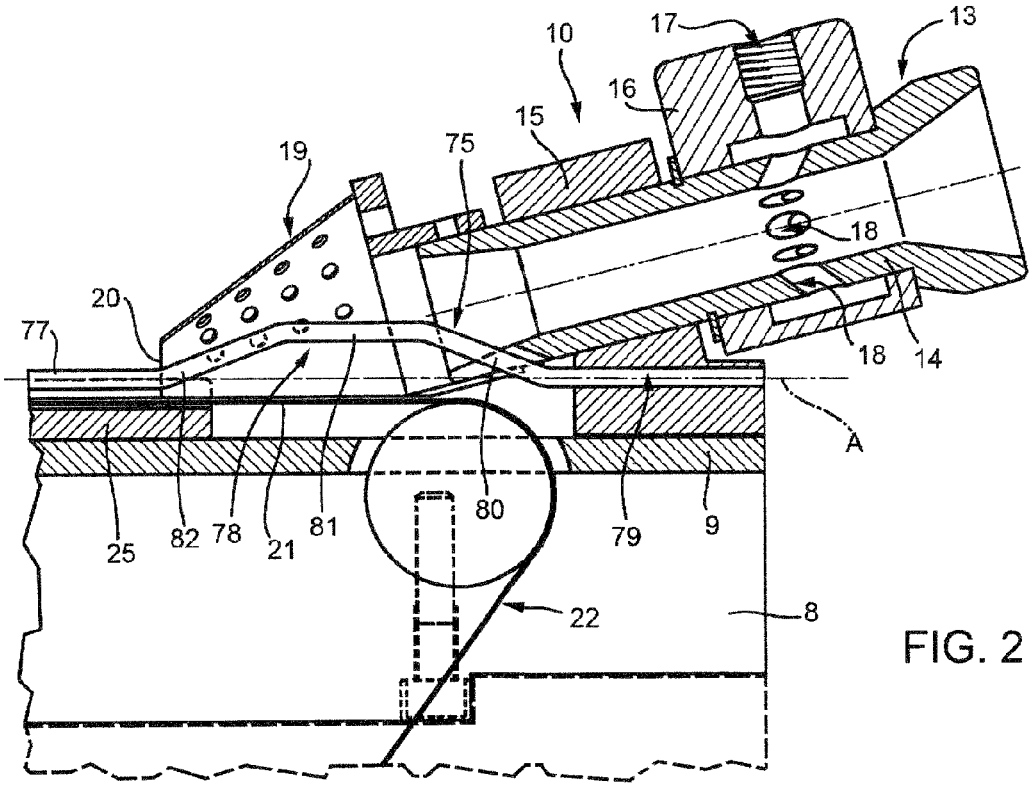
FIG. 2
FIG. 3
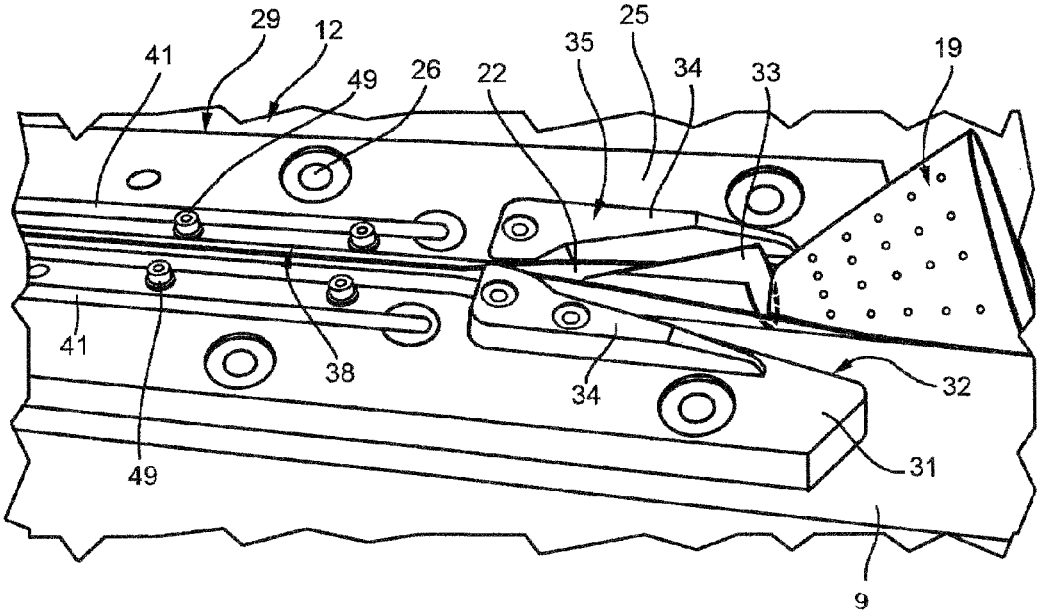

METHOD AND MACHINE FOR PRODUCING PAPERLESS FILTER RODS FOR SMOKING ARTICLES

CROSS-REFERENCE TO RELATED APPLICATIONS

This application claims the benefit of Italian Patent Application No. BO2012A 000106, filed Mar. 5, 2012, the entirety of which is hereby incorporated by reference.

FIELD OF THE INVENTION

The present invention relates to a method and a machine for producing paperless filter rods for smoking articles.

BACKGROUND OF THE INVENTION

It is known in the tobacco industry to make paperless filter rods using a continuous tape of filtering material, normally cellulose acetate, which is continuously fed through an impregnation station, at which the tape is impregnated with a hardening substance, normally triacetin, and is then transformed, by means of blowing air, into a generally cylindrical tow band, which is caused to advance along a longitudinal through channel of a forming beam comprising a first portion, in this case a stabilization portion, and a second portion, in this case a drying portion. Along the first portion, the hardening substance in the tow band is caused to react by means of blowing steam, normally water steam; while, along the second portion, the tow band, previously moistened by the steam, is dried so as to come out of the forming beam in the form of a continuous rod having a determined stable section and relatively high axial rigidity.

This continuous rod is hence fed, again with continuous motion, to a cutting station to be cut into filter segments of determined length.

The advancing of the tow band along the longitudinal channel of the forming beam is normally obtained by means of a loop conveyor defined by a porous conveyor belt that is permeable to the steam, and comprising a transport stretch extending along the longitudinal channel of the forming beam. The longitudinal channel has a variable section shaped so as to act on the conveyor belt so as to deform it crosswise and cause it to take a tubular configuration wound about the tow band to define, about the tow band, a relatively rigid armature, which on the one hand is permeable to steam and, on the other, tightens about the tow band so as to both give it the determined constant shape of a cross section, and to ensure an axial dragging coupling between tow band and conveyor belt.

Instead, downstream from the forming beam and the mentioned conveyor belt, the newly-formed continuous rod is push advanced, and this type of advancing is only made possible by the fact that, as previously mentioned, the continuous rod is axially rigid.

The need for the continuous rod coming out from the forming beam to be rigid, that is perfectly stabilized and dried, has greatly affected the methodologies used to date for making paperless filter rods and has led to making machines in which, as soon as the mentioned tow band enters the longitudinal channel of the forming beam, it is radially hit by a steam flow supersaturated with a relatively high water flow and content and a relatively low speed; the drying portion is relatively long; and the advancing speed of the loop conveyor is relatively low.

The length of the forming beam and the reduced advancing speed of the loop conveyor allow each section of the tow band to remain in the forming beam for a relatively long time and, in all cases, enough to firstly allow the steam to reach the core of the tow band, due to capillary effect, and cause all the hardening substance to react, and, secondly, the tow band to completely dry as it advances along the drying portion.

Finally, the use of the methodologies known to date has allowed good quality paperless filter rods to be obtained, but with relatively low production speeds.

SUMMARY OF THE INVENTION

It is the object of the present invention to provide a method for making paperless filter rods for smoking articles, which allows the quantity of water in the steam flow to be significantly reduced and the production speed to be significantly increased without negatively affecting the quality of the product.

In one aspect, the invention can be a method for producing paperless filter rods for smoking articles, comprising: feeding a tow band of hardening-material-impregnated filtering material, onto porous conveying means extending along a forming channel of a forming beam comprising a stabilizing first portion and a drying second portion; advancing the conveyor means and the tow band along the forming channel; blowing steam through the conveyor means and the tow band as they advance along the first portion to cause the hardening material to react; blowing air through the conveyor means and the tow band as they advance along the second portion to dry the tow band previously moistened by the steam to obtain a continuous paperless rigid rod filter; and feeding the continuous rod coming out from the forming beam to a cutting means to cut the rod crosswise into filter segments of a predetermined length; wherein steam blowing is performed at a number of stabilization stations arranged in series along the first portion; and wherein at each stabilization station, the steam is fed into an accumulation chamber surrounding the forming channel and communicating therewith through an annular nozzle extending on a transverse plane to the forming channel and having a constant width, measured along an axis of the forming channel, of 0.3 to 0.9 mm.

In another aspect, the invention can be a machine for producing paperless filters for smoking articles, the machine comprising a forming beam comprising a stabilizing first portion and a drying second portion and having a forming channel extending along an axis between an input and an output; porous conveying means extending along the forming channel and driven to move along the forming channel in a determined direction, parallel to said axis; feeding means to feed a hardening-material-impregnated filtering material tow band onto the conveying means and upstream from said inlet; stabilizing means arranged along the first portion for injecting steam through the conveying means and the tow band for causing the hardening material to react; drying means arranged along the second portion for blowing air through the conveyor means and the tow band for drying the tow band previously moistened by the steam and to obtain a continuous paperless rigid filter rod; and a cutting device disposed downstream from said outlet in the feed direction to cut the continuous rod crosswise into filter segments of a determined length; wherein the stabilizing means comprises at least two stabilization stations arranged in series along the first portion; and wherein each stabilization station comprises an accumulation chamber surrounding the forming channel; feeding means to feed steam to the accumulation chamber; and an annular nozzle to put the accumulation chamber into communication with the forming channel; the annular nozzle being arranged on a plane extending crosswise to the forming channel and having a constant width, measured along said axis, of 0.3 to 0.9 mm.

BRIEF DESCRIPTION OF THE DRAWINGS

The invention will now be described with reference to the accompanying drawings, which illustrate a non-limiting exemplary embodiment thereof, in which:

FIG. 2 shows an axial section, on enlarged scale and with parts removed for clarity, of a first detail in FIG. 1;

FIG. 3 is a perspective diagrammatic view, with parts removed for clarity, of a second detail in FIG. 1;

DETAILED DESCRIPTION OF THE INVENTION

Figure 1:
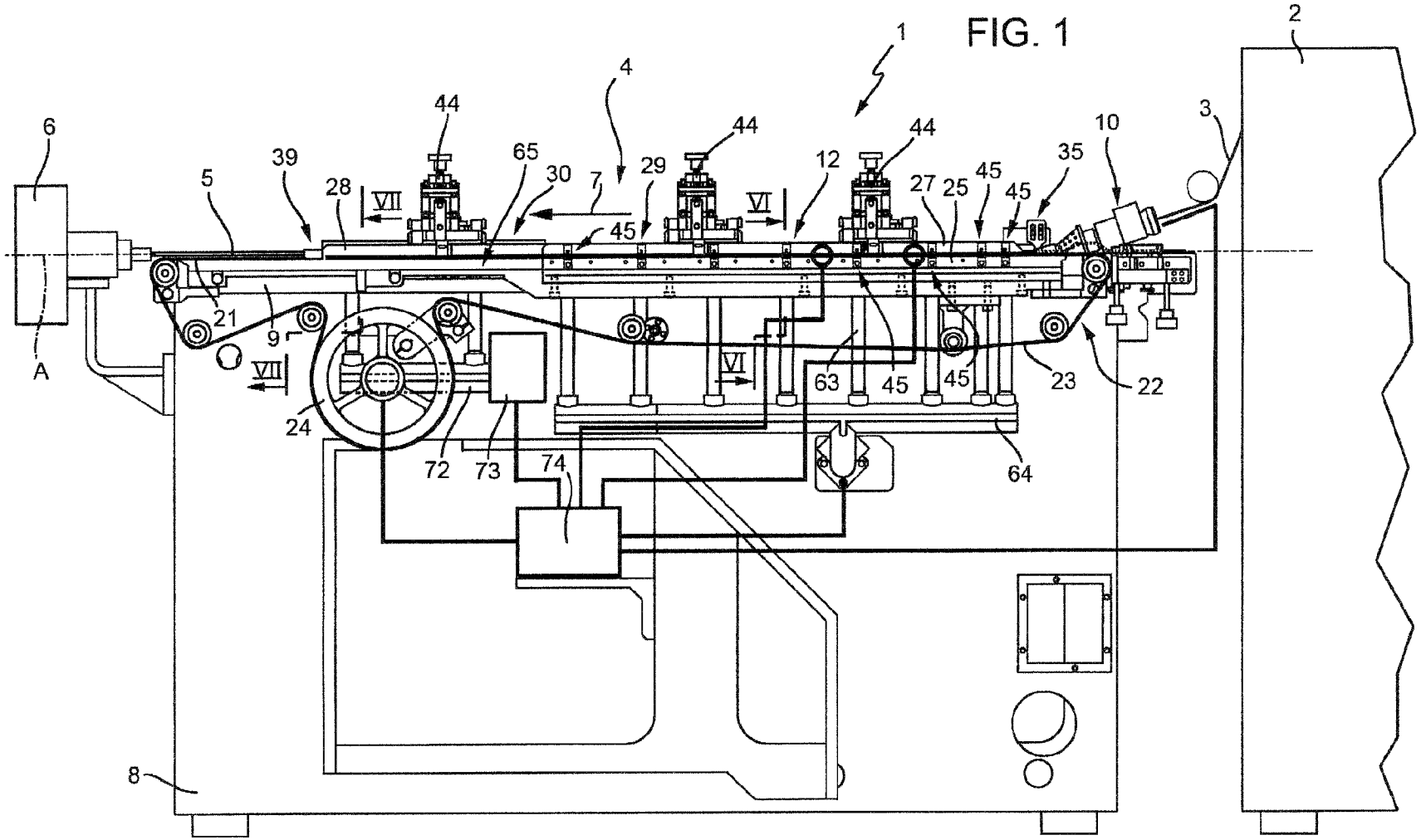
FIG. 1 diagrammatically shows a side elevation view, with parts removed for clarity, of a preferred embodiment of the machine of the present invention.

The following detailed description of the present invention shows a specified embodiment of the present invention and will be provided with reference to the accompanying drawings. The embodiment will be described in enough detail that those skilled in the art are able to embody the present invention. It should be understood that various embodiments of the present invention are different from each other and need not be mutually exclusive. For example, a specific shape, structure and properties, which are described in this disclosure, may be implemented in other embodiments without departing from the spirit and scope of the present invention with respect to one embodiment. Also, it should be noted that positions or placements of individual components within each disclosed embodiment may be changed without departing from the spirit and scope of the present invention. Therefore, the following detailed description is not intended to be limited. If adequately described, the scope of the present invention is limited only by the appended claims of the present invention as well as all equivalents thereto. Similar reference numerals in the drawings designate the same or similar functions in many aspects.

Numeral 1 in FIG. 1 indicates a machine as a whole, for producing paperless filter rods (not shown).

Machine 1 comprises an inlet unit 2, of known type, adapted to produce a tape 3 of filtering material, normally cellulose acetate, moistened with a hardening fluid, normally triacetin; a rod forming unit 4, arranged in series to the inlet unit 2 and adapted to receive tape 3 and to cause the hardening material to react to transform tape 3 into a continuous paperless axially rigid rod filter 5; and a cutting device 6, normally a rotating cutting head of known type, arranged downstream of the rod forming unit 4 in a feed direction 7 of tape 3 and of rod 5, and adapted to cut rod 5 crosswise into paperless filter segments (not shown).

The rod forming unit 4 comprises a base 8 limited at the top by a flat and substantially horizontal panel 9, which supports a pneumatic inlet device 10, of known type, adapted to receive tape 3 saturated with hardening material, to shape tape 3 crosswise so as to transform it into a moist, generally cylindrical tow band 11 and to advance the tow band 11 in the feed direction 7. Panel 9 also supports a forming beam 12 aligned with the pneumatic device 10 in the feed direction 7 to receive the tow band 11 and transform it into the continuous rod 5.

As better shown in FIG. 2, the pneumatic inlet device 10, of known type, comprises a tilted duct 13, which is internally shaped such as a de Laval nozzle and has an intermediate portion 14, which is blocked on panel 9 by means of a bracket 15 and extends through an annular pneumatic distributor 16 consisting of the outlet end of a circuit for feeding 17 a compressed air flow, which penetrates into duct 13 through a plurality of tilted holes 18 obtained through the intermediate portion 14. The air flows coming out from the holes 18 serve the double purpose of pushing tape 3 forwards in the feed direction 7 and towards the forming beam 12, and of expanding tape 3 so as to give it a substantially cylindrical shape and transform it into the tow band 11.

Finally, the pneumatic device 10 comprises a funnel 19, which is connected to an outlet end of duct 13 and is provided with side holes for releasing the air fed through the holes 18. Funnel 19 is also provided with a vertex opening 20 facing the forming beam 12, and, rests on an inlet portion of a transport stretch 21 of a closed loop conveyor belt 22 made of a porous material which is permeable to steam.

As better shown in FIG. 1, the transport stretch 21 extends through the forming beam 12 between a first pulley mounted on base 8 below the pneumatic inlet device 10 and a second pulley mounted on base 8 upstream of the cutting device 6, and the conveyor belt 22 comprises a return stretch 23, which winds about a driven pulley 24 adapted to activate the conveyor belt 22 so that the transport stretch 21 continuously advances, in use, in the feed direction 7 with adjustable speed.

As shown in FIG. 1, the forming beam 12 is defined by a lower plate 25 supported by panel 9 and anchored thereto by means of screws 26 (FIG. 3) and by two covers 27 and 28 arranged in series in the feed direction 7 above plate 25 and defining, with plate 25, a stabilization portion 29 and a drying portion 30, respectively, of the forming beam 12.

As shown in FIG. 3, the lower plate 25 protrudes with two appendixes 31 from the part facing the pneumatic inlet device 10 with respect to cover 27, to define a tapered channel 32, which accommodates a guide scoop 33 of the conveyor belt 22 and defines, together with two opposite jaws 34 carried by the appendixes 31, an inlet station 35, at which the conveyor belt 22 is deformed crosswise so as to take a tubular shape adapted to allow the conveyor belt 22, previously in flat crosswise configuration, to wind about the tow band 11, to couple with the tow band 11 and to cross, with the tow band 11, a forming channel 36 (FIGS. 5 and 6) having an axis A parallel to the feed direction 7 and defined between the lower plate 25 and the covers 27 and 28.

Figure 4:
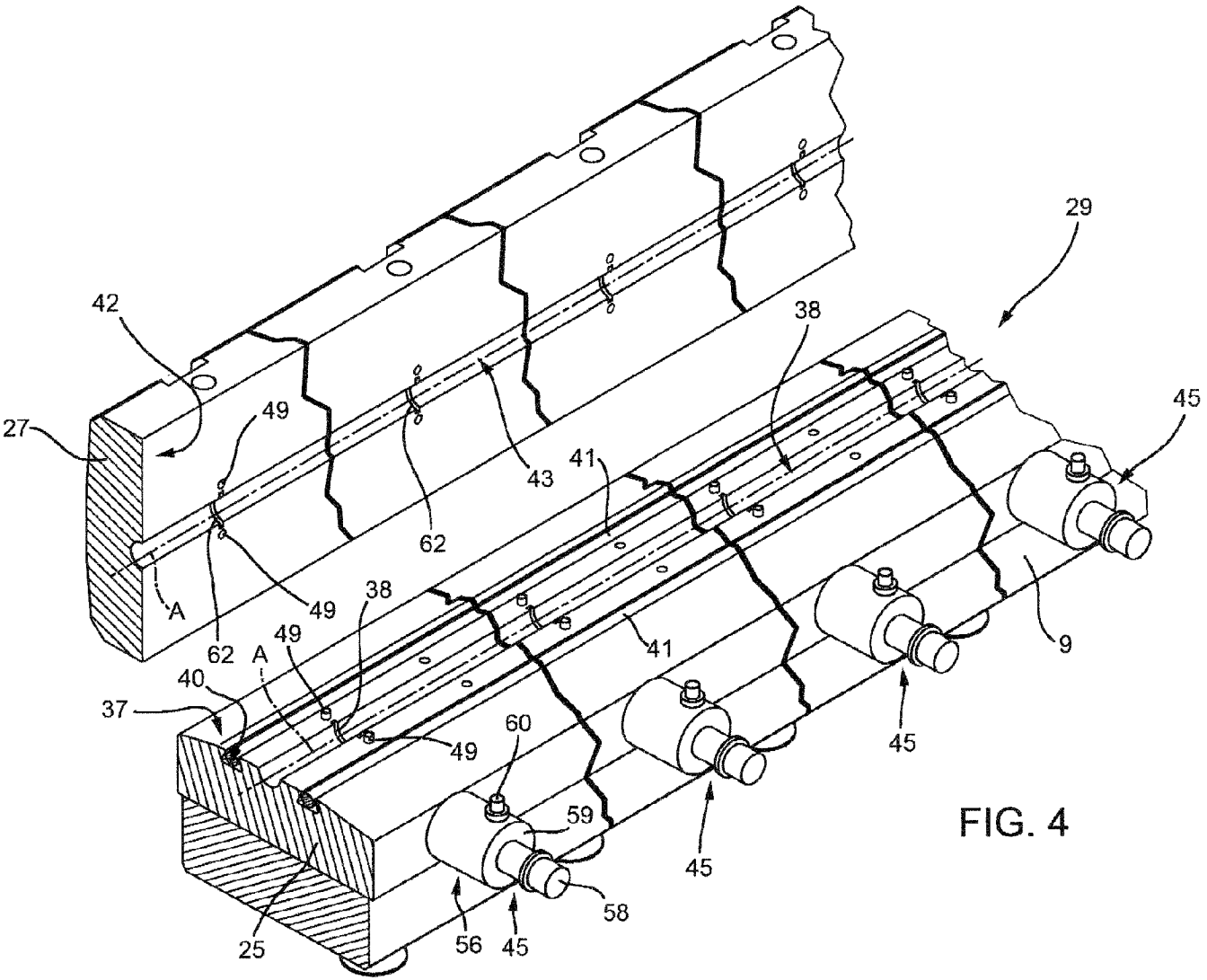
FIG. 4 diagrammatically shows an exploded perspective view, on enlarged scale, of a further detail in FIG. 1.
Figure 5:
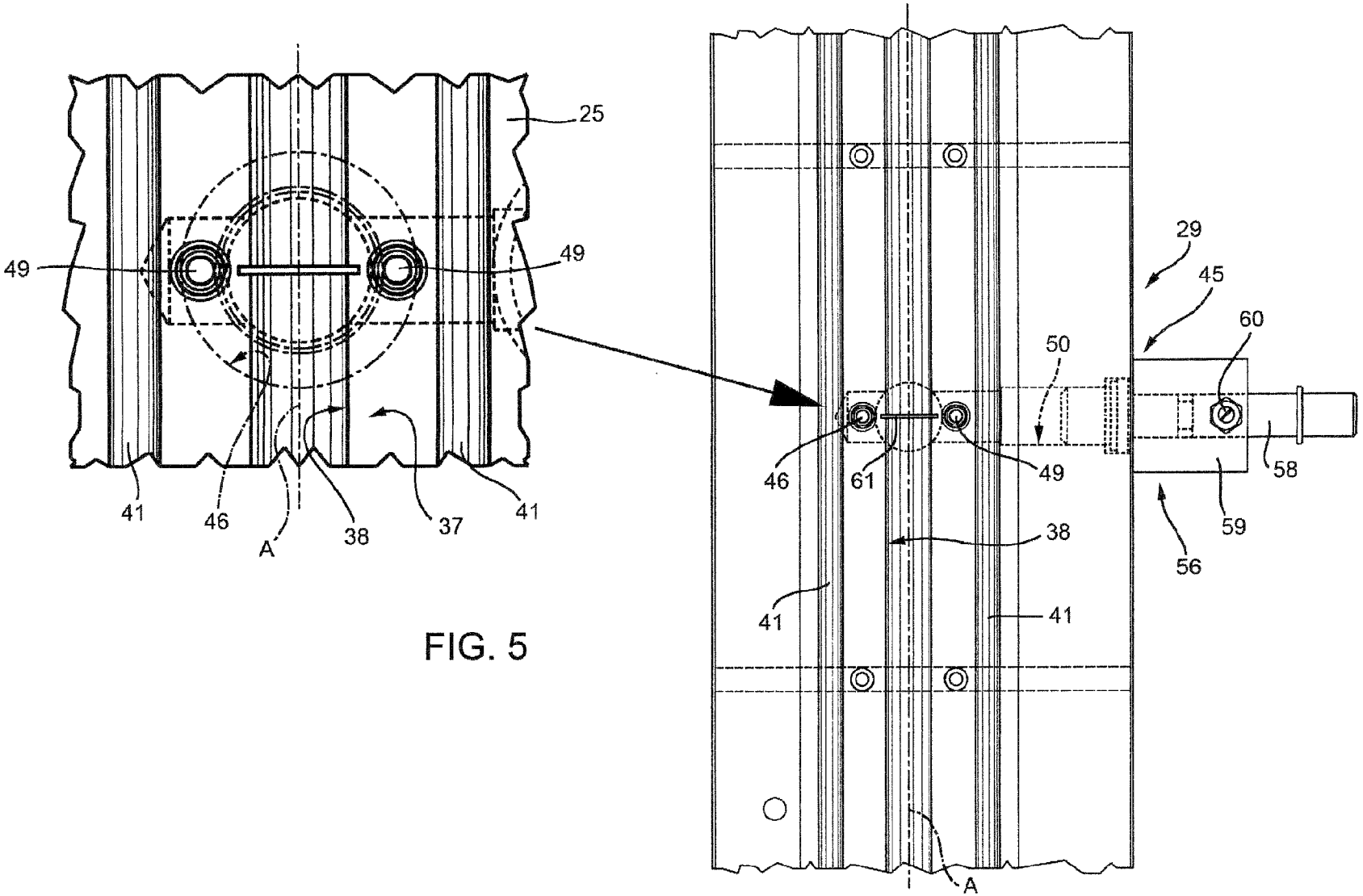
FIG. 5 is a plan view of a detail in FIG. 4.

As better shown in FIGS. 4 and 5, obtained along an upper surface 37 of the lower plate 25 is a substantially semicircular (this section could however differ in shape) groove 38, which extends in the feed direction 7 between the inlet station 35 and an outlet station 39 facing the cutting device 6, but arranged at a determined distance from the cutting station 6 to allow the conveyor belt 22 to resume a flat configuration before the start of the return stretch. In this regard, it is worth pointing out again that, since the conveyor belt 22 separates from the continuous rod 5, thus interrupting the dragging coupling with the continuous rod 5, the continuous rod 5 coming out from the forming beam 12, immediately downstream the outlet station 39, is push fed to the cutting station 6.

Also two further grooves 40 are obtained along the upper surface 37, which are arranged on opposite sides of groove 38, are parallel to groove 38 and accommodate respective gaskets 41 adapted to ensure a fluid-tight coupling between the covers 27 and 28 and the lower plate 25.

With reference only to FIG. 4, a respective groove 43 is obtained along a lower surface 42 of each of the covers 27 and 28. The two grooves 43 are aligned with each other in the feed direction 7, have transversal sections similar to the one of groove 38 and define, in conjunction with groove 38 and when the covers 27 and 28 are blocked on the lower plate 25 by means of respective blocking devices 44 (FIG. 1) and so as to compress the gaskets 41, the forming channel 36 (FIGS. 6 and 7), which extends between the inlet 35 and outlet 39 stations of the forming beam 12.

As shown in FIG. 1, the stabilization portion 29 of the forming beam 12 is divided into a succession of stabilization stations 45 (which are eight in number in the example illustrated, but two of them could be sufficient) distributed along the stabilization portion 29.

Figure 6:
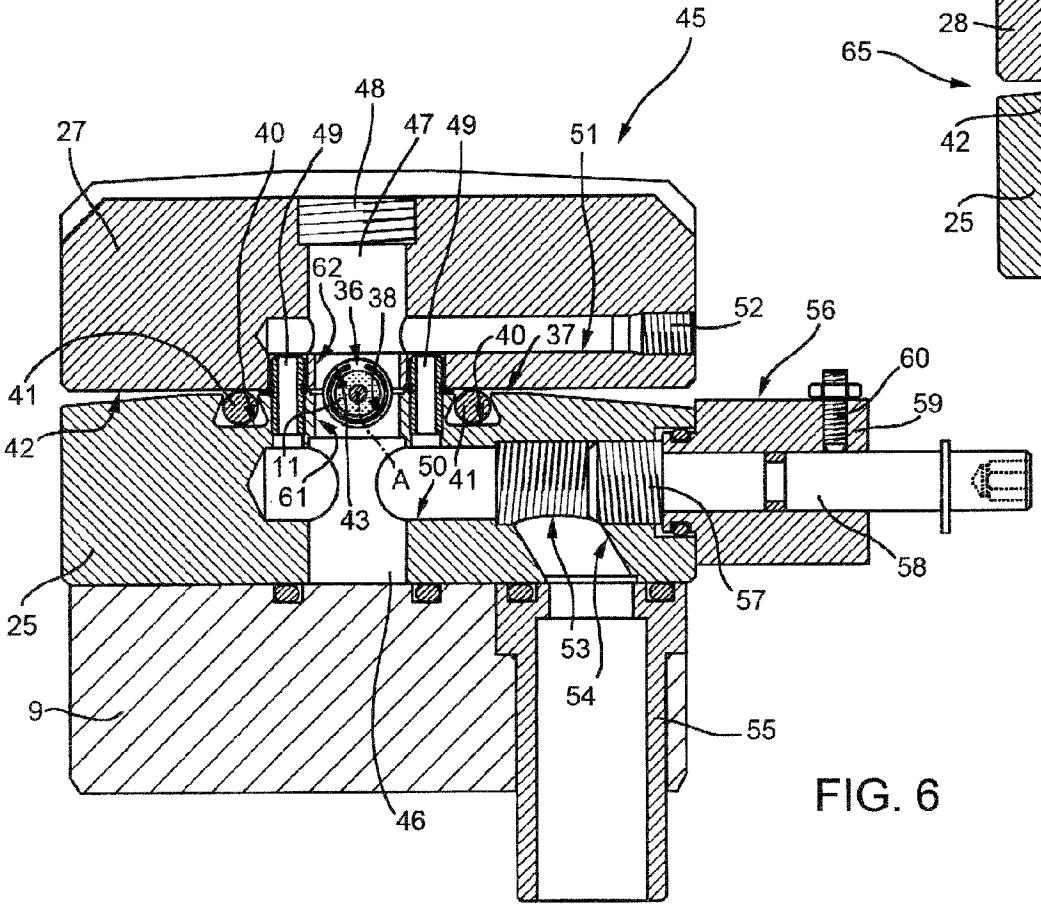
FIG. 6 is a cross section of FIG. 1 according to line VI-VI.

As shown in FIG. 6, each stabilization station 45 comprises a lower chamber 46 obtained through the lower plate 25 below the forming channel 36 and bottomly closed in a fluid-tight manner by panel 9, an upper chamber 47 obtained through cover 27 above the forming channel 36 in position facing the lower chamber 46 and closed at the top by a cap 48, and two vertical ducts 49, which are arranged at opposite sides of the forming channel 36 to place the lower chamber 46 and the upper chamber 47 in communication with each other. Each of the ducts 49 is half formed in the lower plate 25 and half formed in cover 27 and develops at the bottom inside a blind horizontal duct 50, which is obtained in the lower plate 25 and extends crosswise to the feed direction 7 and through the lower chamber 46 immediately below groove 38. Each of the ducts 49 develops at the top inside a blind horizontal duct 51, which is obtained in cover 27, extends crosswise to the feed direction 7 and through the upper chamber 47 immediately above groove 43 and is closed at one end by a cap 52. An intermediate portion 53 of duct 50 communicates, by means of a radial, duct 54 obtained in the lower plate 25, with a tubular steam inlet fitting 55 mounted through panel 9.

The intermediate portion 53 is internally threaded and defines the case of a control valve 56 of the steam flow entering the lower chamber 46, comprising a threaded slider 57 coaxial to the intermediate portion 53 and coupled with the internal threading thereof to move axially along duct 50 between an extracted position, shown in FIG. 6 and of complete opening of the communication between duct 50 and the radial duct 54, and an advanced position (not shown) of total closure of the communication between duct 50 and the radial duct 54. Slider 57 may be controlled from the outside by means of a rod 58, which is coaxial to duct 50, extends outside duct 50 and the lower plate 25 and is carried, rotatably and axially slidingly and outside plate 25, by means of a coupling 59 coupled with the lower plate 25 and provided with a radial screw 60 to block rod 58 with respect to the lower plate 25 itself. Rod 58 may be manually activated or equipped with a motorization (known and not shown) to allow the automatic control of the opening of the control valve 56.

As shown in FIGS. 3, 4 and 6, the lower chamber 46 communicates with the forming channel 36 by means of a semi-annular slit 61 and the constant transversal gap obtained on the bottom of groove 38 between the vertical ducts 49 and crosswise to the feed direction 7; similarly, the upper chamber 47 communicates with the forming channel 36 by means of a slit 62 which is identical to slit 61, coplanar to slit 61 on a transverse plane to axis A and to direction 7 and obtained on the bottom of groove 43 between the vertical ducts 49. The slits 61 and 62 have a width within the range of a fraction of a millimeter, and between 0.3 and 0.9 mm, and preferably equal to about 0.7 mm.

With reference to FIG. 1, each tubular inlet fitting 55 is connected, by means of a respective duct 63, to a collector 64, an inlet of which is connected to a steam generating unit (known and not shown).

As shown in FIG. 1, the drying portion 30 of the forming beam 12 comprises at least two drying stations 65, which are arranged in series in the feed direction 7.

Figure 7:
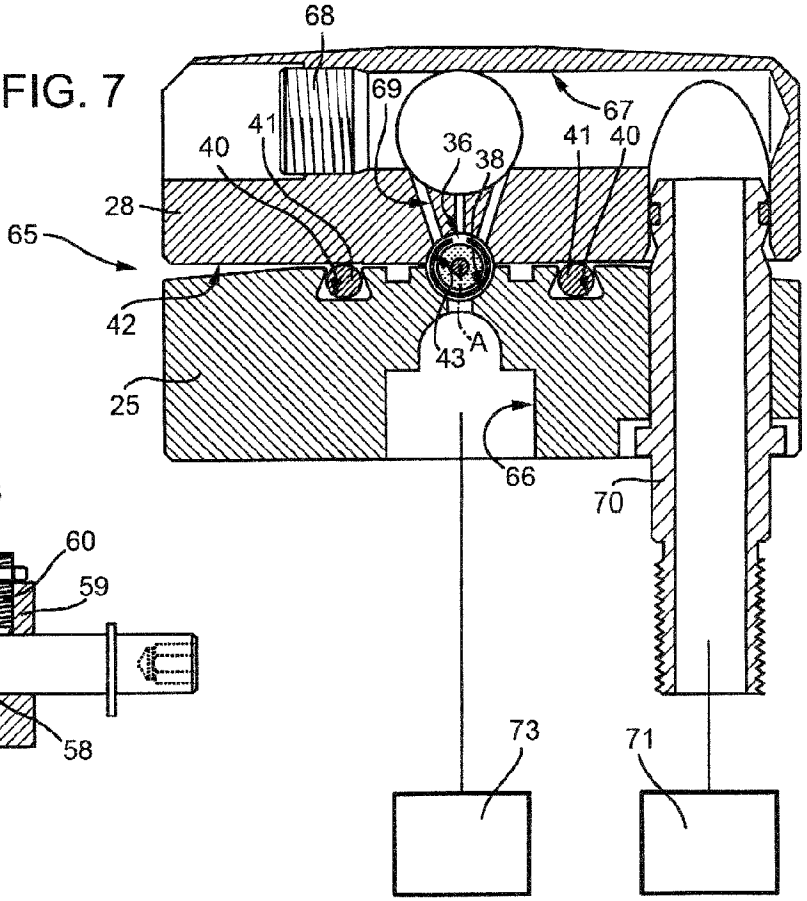
FIG. 7 is a cross section of FIG. 1 according to line VII-V.

As shown in FIG. 7, each drying station 65 comprises a lower chamber 66, which is obtained through the lower plate 25 below the forming channel 36, communicates at the top with the forming channel 36 and is bottomly closed in a fluid-tight manner by panel 9; an upper chamber 67, which is defined by a horizontal blind hole closed at one end by a cap 68 and obtained through cover 28 crosswise to the feed direction 7 and above the forming channel 36 in a position facing the lower chamber 66; and a plurality of ducts 69 extending to the upper chamber 67 to place the upper chamber 67 in communication with the forming channel 36 and, hence, with the lower chamber 66 by means of the forming channel 36. The upper chamber 67 also communicates, by means of a tubular fitting 70 mounted through cover 28, the lower plate and panel 9, with a pressurized air source 71, while the lower chamber 66 communicates with a suction collector 72 connected to a vacuum pump 73.

Machine 1 is regulated, in use, by a control unit 74 capable of controlling, among other things, the feed speed of tape 3, the control valves 56, the flow, temperature and saturation of the steam fed to the collector 64, and the vacuum pump 73.

The general operation of machine 1 does not differ from the general operation of a known machine of the same type, and does not require further explanation.

What does instead require a particular explanation is how the exposure is controlled, in machine 1, of the tow band 11 to the action of the steam along the stabilization portion 29 of the forming beam 12, while considering that:

- As with any known machine of the same type, despite all precautions being taken to eliminate the water from the steam which is fed to collector 64, this steam is always steam supersaturated with micro-drops of suspended water;
- The greater the steam flow that hits the tow band 11, the greater the number of micro-drops of water that penetrate into the tow band 11;
- All water drops that penetrate into the tow band 11 generate a moisture point inside the tow band 11, the elimination of which requires relatively long drying time.

In known machines, steam is normally fed to the tow band by means of a feed duct ending with a nozzle arranged radially with respect to the tow band. Thus, there is a need for relatively large steam flows (i.e. with significant transport of water drops) and relatively long exposure times of the steam and drying times (i.e. relatively reduced advancing speed of the tow band) to allow both the steam to permeate the entire section of the tow band, and, the drying of the moist points.

In each stabilization station 45 in machine 1, the slits 61 and 62 define, as a whole, an annular nozzle capable of shooting an annular steam jet which, fed steam being equal, at least halves the permeation times of the tow band 11. Achieving the result is promoted by the fact that the mentioned annular nozzle has a relatively reduced passage gap (0.3 and 0.9 mm and preferably equal to about 0.7 mm), to which, steam flow being equal, an outflow speed of the steam corresponds and therefore, a relatively high penetration capacity.

Furthermore, the feeding of the steam along the stabilization portion 29 of the forming beam 12 is divided among a plurality of stabilization stations 45, with the consequence that the steam flow and therefore, the ability of the steam to transport micro-drops of water, are drastically reduced.

Lastly, it is worth pointing out that the steam at each stabilization station is not directly fed to the mentioned annular nozzle, but through an accumulation chamber (lower chamber 46 and upper chamber 47).

The presence of this accumulation chamber, combined with the fact that the transversal dimensions of the mentioned annular nozzle and the steam flow through it are, in all, cases, greatly reduced, result in most of the steam inside the mentioned accumulation chamber remaining under substantially static conditions, and that only that part of this steam which is located in the immediate vicinity of the mentioned annular nozzle undergoes a sudden acceleration which, by inertia, only involves the unsaturated (lighter) part of the steam and not the micro-drops of water possibly suspended therein.

The final result is that a "blade" jet of practically dry steam comes out of the mentioned annular nozzle, and activates the hardener, but moistens the tow band 11 in an insignificant manner thus shortening the drying times and making possible advancing speeds of the tow band 11 almost double of those detectable in known machines of the same type as machine 1.

With regard to the above, it is worth pointing out that many tests performed on machine 1 have shown that, if dividing the steam flow in several stabilization stations 45 (up to eight stabilization stations 45 arranged in series along the forming beam 12) has proven to be an accessory feature tending to improve the final results (if necessary, use of only part of the stabilization stations 45 may be sufficient), the presence of mentioned annular nozzle, the transversal dimensions (width of slits 61 and 62) of the annular nozzle and the presence of accumulation chamber (chambers 45 and 46) for feeding the annular nozzle have proven to be "critical" features. For example, simply eliminating the accumulation chamber and/or using slits 61 and 62 that are just one or two tenths wider with respect to the indicated range of variation (0.3-0.9 mm) results in the predetermined results no longer being achievable.

As shown in FIG. 2, coupled with the pneumatic device 10 is an inner-shaping device, which is only present if axially holed paperless filter rods are to be produced, while, obviously, it is not there if full paperless filter rods are to be produced.

The inner-shaping device is defined by a mandrel 75, which is equal in diameter to the one of the axial hole to be obtained, is substantially "omega" shaped and comprises two end portions 76 and 77 which are coaxial to each other and to axis A, and a curved intermediate portion 78 with concavity facing downwards. The end portion 76 is blocked inside a hole 79 obtained coaxially to axis A through the foot of the support bracket 15 of duct 13; the end portion 77 engages, with radial clearance, an inlet portion, normally limited to the first two or three stabilization stations 45, of the forming channel 36; while the intermediate position 78 comprises an ascending length 80, which is joined to the end portion 76 and penetrates into duct 13 through a specific slit by being arranged on the course followed by the tow band 11 coming out from duct 13, an intermediate length 81, which is parallel to axis A and is arranged inside funnel 19, and a descending length 82, which is arranged inside funnel 19 and joins the intermediate length 81 to the end portion 77.

In use, by coming in contact with the ascending length 80 first, and then with the intermediate length 81, the tow band 11, which is moistened and plastically deformable, deforms into a U shape, with a concavity facing downwards, astride of mandrel 75. When the tow band 11 reaches the descending length 82, the two arms of the U join together below mandrel 75 due to the effect of the pneumatic compression that the tow band 11 undergoes at opening 20. The tow band 11 takes its original shape again at the inlet of the forming channel 36, and perfectly envelopes the end portion 77 of mandrel 75.

If the inner-shaping device defined by mandrel 75 is present, preferably only the stabilization stations 45 crossed by the end portion 77 are activated, since there is a possibility that the axial hole just made through the tow band 11 closes if any one stabilization station 45 were activated downstream the end portion 77.

According to a different variation not disclosed, tape 3 is axially cut into two semi-tapes, each of which is fed to a respective pneumatic inlet device 10 to produce a semi-tow band. These two pneumatic inlet devices 10 are arranged tilted with respect to each other, converge one towards the other and towards the inlet station 35 and are arranged one above and the other below a mandrel or straight core, which, is coaxial to axis A, penetrates into the forming channel 36 for a determined length and is arranged between the two semi-tow bands, which are deformed by the conveyor belt 22 to form a tubular tow band 11 which is perfectly wound about the mentioned mandrel.

In the above-mentioned variation not disclosed, half cutting tape 3 is advantageous, as compared to using two separate, smaller tapes, because this involves using a single inlet unit 2; furthermore, use of a straight mandrel to make a tubular tow band 11 allows the same alternate axial movements and/or rotary movements—which tend to prevent any adhesion of the tow band 11 to the mandrel—about axis A to be given to the mandrel with extreme ease.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A method for producing paperless filter rods for smoking articles, comprising:

feeding a tow band of hardening-material-impregnated filtering material onto porous conveying means extending along a forming channel of a forming beam comprising a stabilizing first portion and a drying second portion;

advancing the conveyor means and the tow band along the forming channel;

blowing steam through the conveyor means and the tow band as they advance along the first portion to cause the hardening material to react;

blowing air through the conveyor means and the tow band as they advance along the second portion to dry the tow band previously moistened by the steam to obtain a continuous paperless rigid rod filter; and feeding the continuous rod coming out from the forming beam to a cutting means to cut the rod crosswise into filter segments of a predetermined length;

wherein the steam blowing is performed at a number of stabilization stations arranged in series along the first portion;

wherein at each stabilization station, the steam is fed into an accumulation chamber surrounding the forming channel and communicating therewith through an annular nozzle extending on a transverse plane to the forming channel and having a constant width, measured along an axis of the forming channel, of 0.3 to 0.9 mm, the annular nozzle having a first semi-annular portion above the axis of the forming channel and a second semi-annular portion below the axis of the forming channel, the first and second semi-annular portions of the annular nozzle aligned on the transverse plane;

wherein the accumulation chamber includes a first and a second steam chamber communicating with each other, the first steam chamber communicating with the forming channel through a first semi-annular slit forming the first semi-annular portion of the nozzle and the second steam chamber communicating with the forming channel through a second semi-annular slit defining the second semi-annular portion of said annular nozzle, the steam being fed through each of the first and second semi-annular slits into the forming channel; and wherein the steam blowing comprises blowing the steam through each of the first and second semi-annular portions of the annular nozzle towards the forming channel along the transverse plane.

2. The method claimed in claim 1, wherein the width of the annular nozzle is equal to 0.7 mm.

3. The method claimed in claim 1, wherein the steam is fed to the accumulation chamber through a control valve of the steam flow fed to the accumulation chamber.

4. The method claimed in claim 1, wherein the first and the second steam chambers communicate with each other through ducts formed through the forming beam outside the forming channel.

5. The method claimed in claim 1, wherein blowing air through the conveyor means and the tow band is performed at at least two drying stations arranged in series along the second portion; and wherein, at each drying station, air is fed into the forming channel and is then sucked away from the forming channel via suction means.

6. The method claimed in claim 1, and further forming a continuous axial hole along the tow band to obtain a continuous tubular rod, the hole being made by deforming the tow band entering the forming channel about a mandrel extending for a determined length along the first portion.

7. A machine for producing paperless filters for smoking articles, the machine comprising:

a forming beam comprising a stabilizing first portion and a drying second portion and having a forming channel extending along an axis between an input and an output, the forming channel defined by a surface;

porous conveying means extending along the forming channel and driven to move along the forming channel in a determined direction parallel to said axis;

feeding means to feed a hardening-material-impregnated filtering material tow band onto the conveying means and upstream from said inlet;

stabilizing means arranged along the first portion for injecting steam through the conveying means and the tow band for causing the hardening material to react;

drying means arranged along the second portion for blowing air through the conveyor means and the tow band for drying the tow band previously moistened by the steam and to obtain a continuous paperless rigid filter rod; and a cutting device disposed downstream from said outlet in the feed direction to cut the continuous rod crosswise into filter segments of a determined length;

wherein the stabilizing means comprises at least two stabilization stations arranged in series along the first portion; and wherein each stabilization station comprises:

an accumulation chamber surrounding the forming channel, the accumulation chamber comprising a first and a second chamber communicating with each other;

feeding means to feed steam to the accumulation chamber; and an annular nozzle to put the accumulation chamber into communication with the forming channel, the annular nozzle formed by an annular slit that is formed into the surface defining the forming channel and that circumferentially surrounds the axis of the forming channel, the annular nozzle being arranged on a plane extending crosswise to the forming channel and having a constant width, measured along said axis, of 0.3 to 0.9 mm; and wherein the first and the second chamber of the accumulation chamber communicate with the forming channel through a first and, respectively, a second semi-annular slit defining, as a whole, said annular slit that forms said annular nozzle, the feeding means being connected to the first chamber, and wherein the steam is fed from the first chamber into the forming chamber through the first semi-annular slit and from the second chamber into the forming chamber through the second semi-annular slit.

8. The machine claimed in claim 7, wherein the width of the annular nozzle is equal to 0.7 mm.

9. The machine claimed in claim 7, wherein each stabilization station comprises a control valve for the steam flow fed to the accumulation chamber.

10. The machine claimed in claim 7, wherein the first and the second chambers communicate with each other through ducts formed through the forming beam outside the forming channel.

11. The machine claimed in claim 7, wherein the drying means comprise at least two drying stations arranged in series along the second portion; each drying station comprising air feeding means for feeding air into the forming channel and air suction means for sucking air from the forming channel; said air feeding means and said suction means being arranged on opposite sides of the forming channel.

12. The machine claimed in claim 7, wherein the forming beam comprises a lower plate having a first groove extending along said axis, and cover means arranged over the lower plate along the first groove, fixed in a fluid-tight manner to the lower plate and having, on the side facing the lower plate, a second groove extending along said axis and defining, with the first groove, the forming channel.

13. The machine claimed in claim 12, wherein, in each stabilization station, the first chamber is formed in the lower plate and the second chamber is formed in the cover means.

14. The machine claimed in claim 7, further comprising an inner-shaping means to achieve an axial hole along the tow band entering the forming beam, the inner-shaping means comprising a mandrel rod, an end portion of which extended coaxially to said axis through the inlet and along a given length of the first portion.

15. The machine claimed in claim 7 wherein the annular slit forms a continuous annular passageway between the accumulation chamber and the forming channel that is arranged on the plane extending crosswise to the forming channel.

16. A method for producing paperless filter rods for smoking articles, comprising:

feeding a tow band of hardening-material-impregnated filtering material onto porous conveying means extending along a forming channel of a forming beam comprising a stabilizing first portion and a drying second portion, the forming channel defined by a surface;

advancing the conveyor means and the tow band along the forming channel;

blowing steam through the conveyor means and the tow band as they advance through a stabilizing station along the first portion to cause the hardening material to react;

blowing air through the conveyor means and the tow band as they advance along the second portion to dry the tow band previously moistened by the steam to obtain a continuous paperless rigid rod filter; and feeding the continuous rod coming out from the forming beam to a cutting means to cut the rod crosswise into filter segments of a predetermined length;

wherein at the stabilization station, the steam is fed into an accumulation chamber surrounding the forming channel and from the accumulation chamber into the forming channel through an annular slit that is formed into the surface of the forming channel and that forms an annular nozzle that extends on a plane that is transverse to the forming channel;

wherein the accumulation chamber includes a first and a second steam chamber communicating with each other and wherein the annular slit comprises a first semi-annular slit and a second semi-annular slit, the first steam chamber communicating with the forming channel through the first semi-annular slit and the second steam chamber communicating with the forming channel through the second semi-annular slit.

17. The method claimed in claim 16 wherein the steam is transmitted from the accumulation chamber into the forming channel through the annular nozzle as an annular steam jet along the plane that is transverse to the forming channel.

18. The method claimed in claim 16 wherein the steam blowing is performed at a number of the stabilization stations arranged in series along the first portion, and wherein the annular slit of each of the stabilizing stations has a constant width, measured along an axis of the forming channel, of 0.3 to 0.9 mm.

19. The method of claim 16 wherein the first and the second steam chambers communicate with each other through ducts that are not in direct communication with the annular nozzle.

* * * * *